US008596844B1

(12) United States Patent
Yeh

(10) Patent No.: US 8,596,844 B1
(45) Date of Patent: Dec. 3, 2013

(54) VEHICLE LIGHT

(75) Inventor: Keng-Chin Yeh, New Taipei (TW)

(73) Assignee: Grang Fair Industrial Co., Ltd., New Taipei (TW)

( * ) Notice: Subject to any disclaimer, the term of this patent is extended or adjusted under 35 U.S.C. 154(b) by 0 days.

(21) Appl. No.: 13/532,111

(22) Filed: Jun. 25, 2012

(51) Int. Cl.
*F21S 8/10* (2006.01)

(52) U.S. Cl.
USPC ..... 362/545; 362/507; 362/510

(58) Field of Classification Search
USPC ..... 362/507, 545–549
See application file for complete search history.

(56) References Cited

U.S. PATENT DOCUMENTS

| | | | | |
|---|---|---|---|---|
| 6,657,767 | B2 * | 12/2003 | Bonardi et al. | 359/265 |
| 6,733,164 | B1 * | 5/2004 | Smith, Jr. | 362/545 |
| 2004/0114392 | A1 * | 6/2004 | Hou | 362/545 |
| 2005/0286259 | A1 * | 12/2005 | Wang | 362/545 |
| 2006/0234612 | A1 * | 10/2006 | Gotthardt | 452/58 |
| 2013/0027955 | A1 * | 1/2013 | Grote et al. | 362/510 |

* cited by examiner

*Primary Examiner* — Mary Ellen Bowman
(74) *Attorney, Agent, or Firm* — C. G. Mersereau; Nikolai & Mersereau, P.A.

(57) ABSTRACT

A vehicle light includes a housing having at least one first slot and at least one light strip made by plastic, fluorescent agent and proliferation powder is engaged with the at least one first slot. At least one first LED light unit is connected to the back of the at least one light strip and has a first circuit board that is shaped to be matched with the at least one light strip. The first circuit board has multiple LED chips located corresponding to the at least one light strip. A back board and a cover are fixed to the back and the front of the housing. The vehicle light has simple structure and provides desired light patterns.

5 Claims, 5 Drawing Sheets

VEHICLE LIGHT

BACKGROUND OF THE INVENTION

1. Field of the Invention

The present invention relates to a vehicle light, and more particularly, to a vehicle light that displays light lines or strips.

2. Description of the Prior Art

The conventional vehicle lights in the present market are required to have specific shapes and the illumination has to meet the requirements of the relative laws so as to provide sufficient illumination feature to ensure safety of driving. The vehicle lights have to provide illumination, warning and indicating features so that the drivers can be acknowledged the intension and possible movement of the vehicles to keep the orders and safety on the roads.

The conventional vehicles use Light Emitting Diodes (LEDs) as the light source and which save electric energy. The illumination and light pattern is affected by the types of light sources, the shape and size of the reflection lens/transparent lens and the relative positions between the grid plates and the reflection lens/transparent lens. In order to increase the illumination of the conventional vehicle lights, the number of the LEDs is increased and the LEDs are arranged in rectangular or circular pattern on the circuit. However, the conventional vehicle lights look similar so that the road users may ignore the signals and affect the safety on the roads.

The present invention intends to provide a vehicle light which has simple structure and provides better light shape.

SUMMARY OF THE INVENTION

The present invention relates to a vehicle light and comprises a housing having at least one first slot and at least one light strip made by plastic, fluorescent agent and proliferation powder is engaged with the at least one first slot. The at least one light strip has a body which is shaped to be engaged with the at least one first slot. At least one first LED light unit is connected to the back of the at least one light strip and has a first circuit board that is shaped to be matched with the at least one light strip. The first circuit board has multiple LED chips located corresponding to the at least one light strip. A back board is fixed to the back of the housing and a cover is fixed to the front of the housing.

The vehicle light has simple structure and provides desired light patterns. The light strip does not have obvious light spots and the at least one first LED light unit is evenly located in the at least one first slot to form the specific light pattern.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
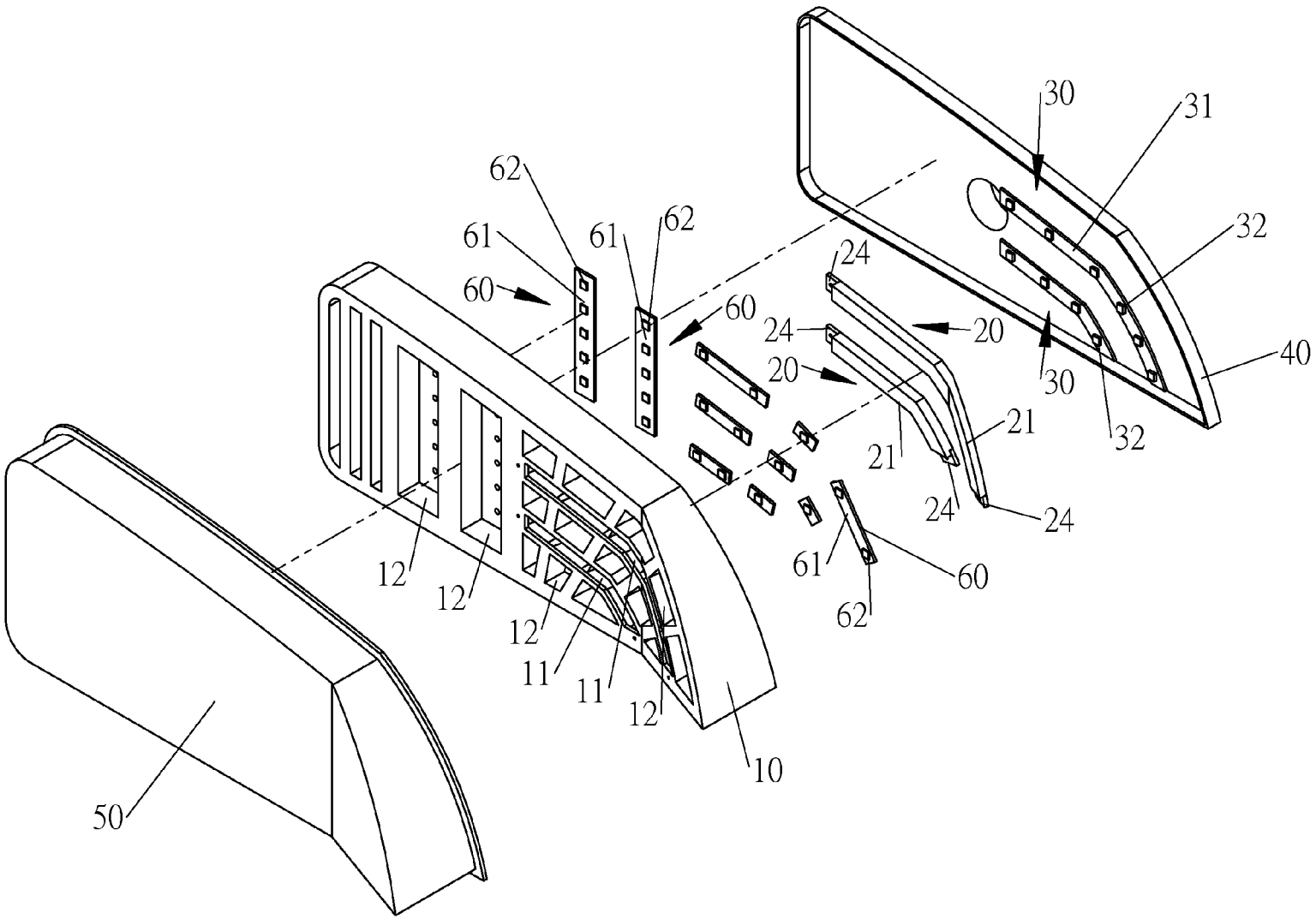
FIG. 1 is an exploded view to show the vehicle light of the present invention.
Figure 2:
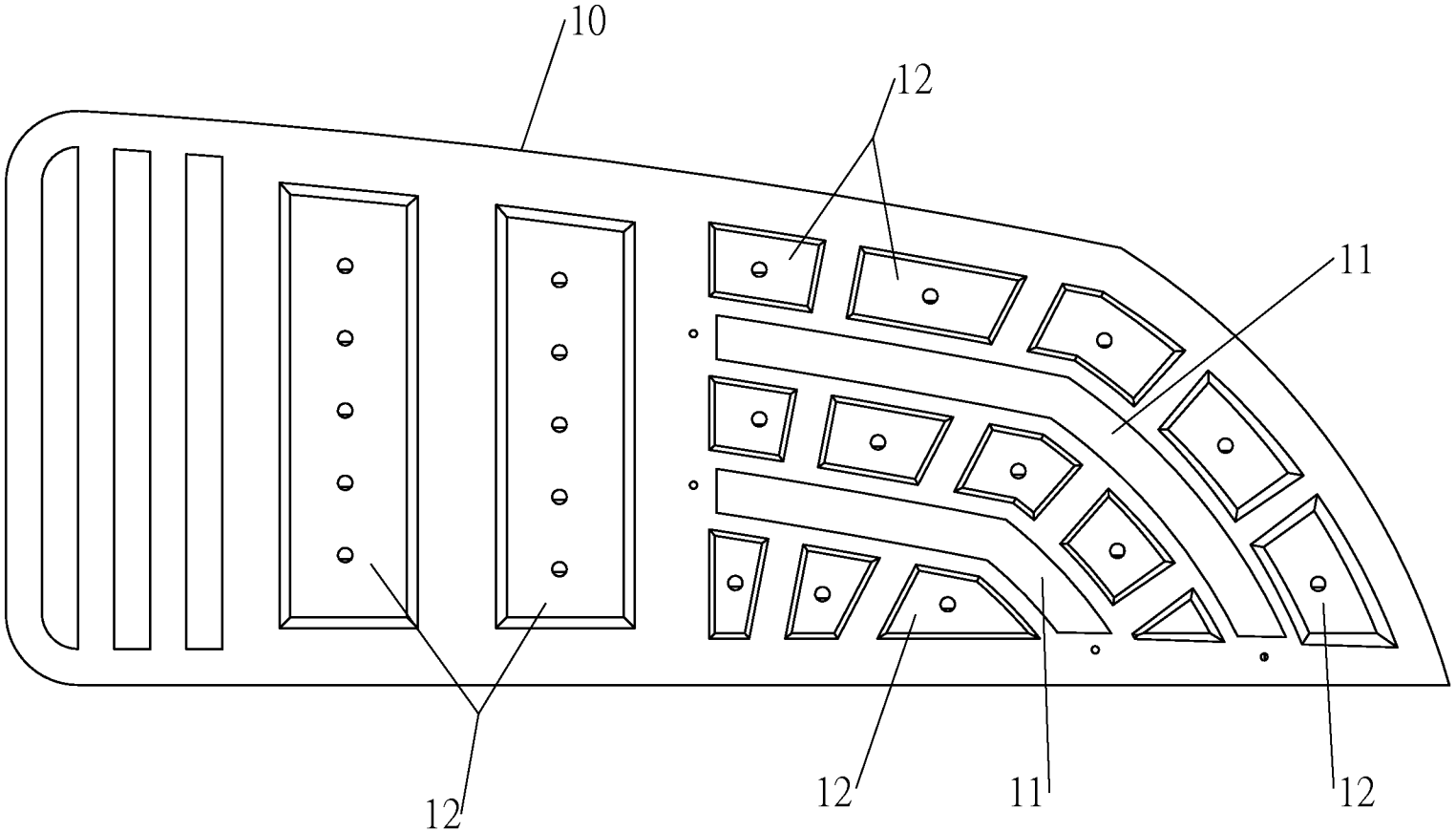
FIG. 2 shows the front view of the housing of the vehicle light of the present invention.
Figure 3:
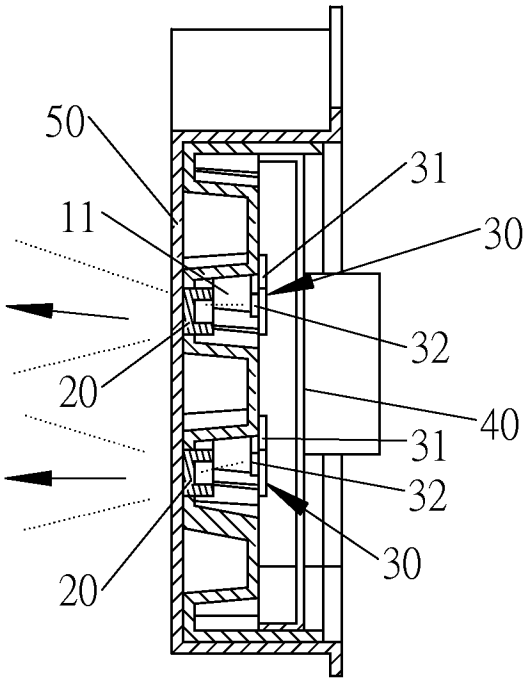
FIG. 3 is a cross sectional view of the vehicle light of the present invention.

Referring to FIGS. 1 to 3, the vehicle light of the present invention of the present invention comprises a housing 10, at least one light strip 20, at least one first LED light unit 30, a back board 40 and a cover 50.

The housing 10 has at least one first slot 11, there are two parallel
first slots 11 in this embodiment and the two parallel first slots 11 are bent an angle.

The at least one light strip 20 is engaged with the at least one first slot 11 and made by plastic, fluorescent agent and proliferation powder. The at least one light strip 20 has a body 21 which is shaped to be engaged with the at least one first slot 11. In this embodiment, there are two light strips 20 which are bent to be respectively engaged with the first slots 11.

The at least one first LED light unit 30 is connected to the back of the at least one light strip 20 and has a first circuit board 31 that is shaped to be matched with the at least one light strip 20. The first circuit board 31 has multiple LED chips 32 located corresponding to the at least one light strip 20. In this embodiment, each of the light strips 20 has one first LED light unit 30 connected to the back thereof and the first circuit board 31 of each first LED light unit 30 is bent corresponding to the light strip 20.

The back board 40 is fixed to the back of the housing 10 to cover up the light strips 20, the first and second LED light units 30, 60. The back board 40 can be also used to position the first LED light unit 30.

The cover 50 is a transparent cover and mounted to the front of the housing 10. In this embodiment, the cover 50 is mounted to the front and the back of the housing 10 to cover up all the parts.

The vehicle light of the present invention provides a simple structure and reliable vehicle light. The light strips 20 prevent obvious light spots and each of the first LED light units 30 are evenly located in the first slot 11 to form the specific light pattern of the first slots 11.

Figure 4:
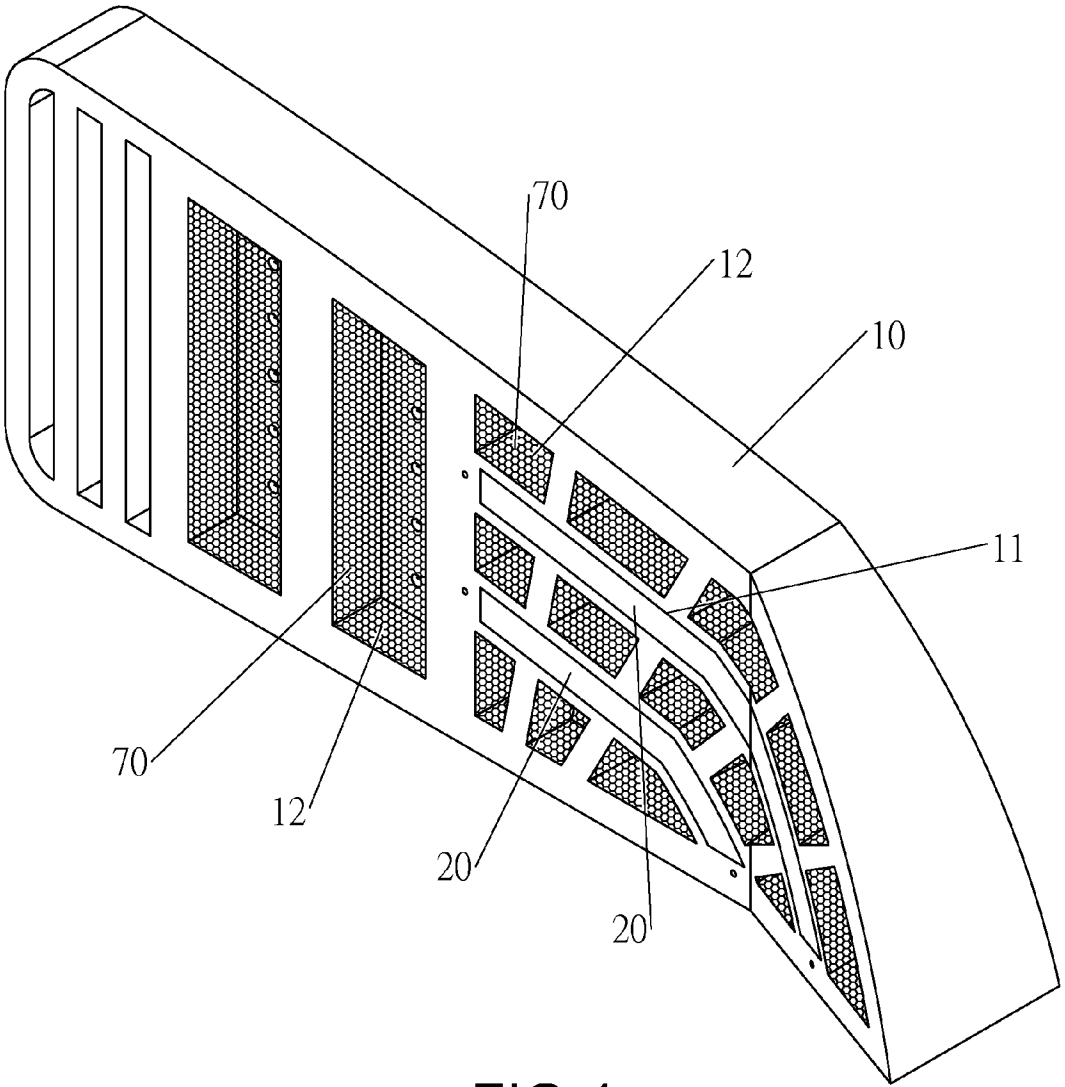
FIG. 4 shows that the gird plates are connected to the second slots of the vehicle light of the present invention.

In the second embodiment, as shown in FIG. 4, the housing 10 has at least one second slot 12 and at least one second LED light unit 60 is engaged with the at least one second slot 12. The at least one second LED light unit 60 has at least one LED chip 62 connected to the second circuit board 61. A grid plate 70 is connected to the housing 10 and located in front of each of the second slots 12 as shown in FIG. 4. The grid plates 70 have different colors according to the functions of the second LED light units 60 corresponding thereto so that the vehicle light has illumination, warning and indicating features. By the operation of the control circuit, different colors and lights are displayed from the first and second slots 11, 12.

Figure 5:
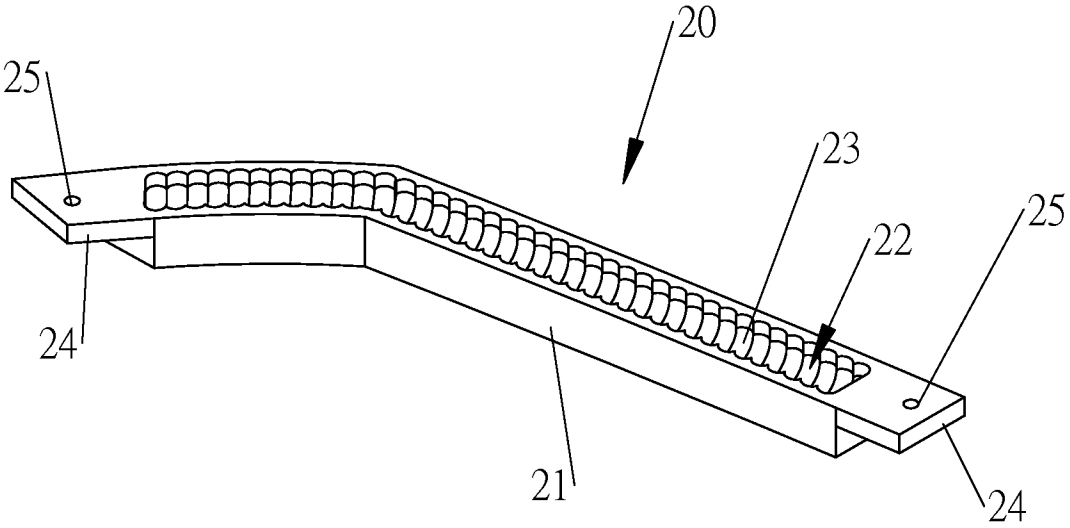
FIG. 5 shows the light strip of the vehicle light of the present invention.

As shown in FIG. 5, when the light strip 20 is used, the light strip 20 has a recess 22 defined in the back of the body 21 and optical etchings 23 are defined in the inner wall of the recess 22 to generate better optical function. The light strip 20 has two lugs 24 respectively extending from two ends thereof and each lug 24 has a hole 25. Two threaded holes are located on two ends of the at least one first slot 11 so that the light strip 20 is fixed to the housing 10 by extending two bolts through the two holes 25 in the lugs 24 and the bolts are connected to the two threaded holes of the two ends of the at least one first slot 11.

The vehicle light of the present invention has simple structure and is reliable, and generates continuous light strips to increase the indicating feature. By the operation of the control circuit, different colors and lights are displayed from the first and second slots 11, 12 such that the vehicle light of the present invention attracts attentions and ensures the safety on the roads.

While we have shown and described the embodiment in accordance with the present invention, it should be clear to those skilled in the art that further embodiments may be made without departing from the scope of the present invention.

What is claimed is:

1. A vehicle light comprising:

a housing having at least one first slot;

at least one light strip engaged with the at least one first slot, the at least one light strip comprising a plastic, a fluorescent agent and a proliferation powder for the fluorescent agent, the at least one light strip having a body which is shaped to be engaged with the at least one first slot;

at least one first LED light unit connected to a back of the at least one light strip and having a first circuit board that is shaped to be matched with the at least one light strip, the first circuit board having multiple LED chips located corresponding to the at least one light strip;

a back board fixed to a back of the housing, and a cover mounted to a front of the housing.

2. The vehicle light as claimed in claim 1, wherein the housing has at least one second slot, at least one second LED light unit is engaged with the at least one second slot and has at least one LED chip connected to a second circuit board.

3. The vehicle light as claimed in claim 2, wherein a grid plate is connected to the housing and located in front of the at least one second slot.

4. The vehicle light as claimed in claim 1, wherein the at least one light strip has a recess defined in a back of the body and optical etchings are defined in an inner wall of the recess.

5. The vehicle light as claimed in claim 1, wherein the at least one light strip has two lugs respectively extending from two ends thereof and each lug has a hole, two threaded holes are located on two ends of the at least one first slot, the at least one light strip is fixed to the housing by extending two bolts through the two holes in the lugs and the two bolts are connected to the two threaded holes of the two ends of the at least one first slot.

* * * * *